United States Patent [19]

Zingale

[11] 4,323,248

[45] Apr. 6, 1982

[54] BOARD GAME EMPLOYING CHANCE-TAKING MEANS

[76] Inventor: Salvatore L. Zingale, 12529 Longmead St., Cleveland, Ohio 44135

[21] Appl. No.: 113,063

[22] Filed: Jan. 17, 1980

[51] Int. Cl.[3] ..... A63F 3/00

[52] U.S. Cl. ..... 273/236; 273/243

[58] Field of Search ..... 273/243, 249, 248, 256, 273/236

[56] References Cited

U.S. PATENT DOCUMENTS

| | | | |
|---|---|---|---|
| 1,559,954 | 11/1925 | Gifford | 273/249 |
| 3,104,106 | 9/1963 | Kenny | 273/249 |
| 4,003,577 | 1/1977 | Bolach | 273/243 |
| 4,171,814 | 10/1979 | Tamano | 273/243 |
| 4,216,594 | 8/1980 | Farley | 273/249 |

*Primary Examiner*—Richard C. Pinkham
*Assistant Examiner*—Carl Moy
*Attorney, Agent, or Firm*—Burge & Porter Co.

[57] ABSTRACT

A board game includes a board and chance-taking means for determining in random manner the play of game cards. Four separate chance-taking means are included as part of the game apparatus, each chance-taking means dealing with a separate category such as shape, color, number, or letter. A plurality of directional cards are placed at the center of the game board and, when drawn, control the direction of player movements about the board. The board includes indicia indicative of various directions in which player movements can be made. Each player is dealt a plurality of play cards having indicia on their faces representative of different shapes, colors, numbers, and letters. The basic object of the game is to rid oneself of all play cards. By sequential activation of the separate chance-taking means, each player moves to different positions on the board where the taking or discarding of additional cards is required. Inactive players may gamble on whether an active player will succeed in discarding a particular card. If the gamble is successful, the gambling players are permitted to discard gambled cards.

6 Claims, 3 Drawing Figures

BOARD GAME EMPLOYING CHANCE-TAKING MEANS

BACKGROUND OF THE INVENTION

1. Field of the Invention

The invention relates to board games and, more particularly, to a game apparatus having means to control the direction and nature of player movements about a game board.

2. Description of the Prior Art

A great number of games employing boards and chance-taking apparatus already are known. In a typical prior game, the board includes indicia indicative of stations to which a player may move a piece controlled by the player. Stations on the board may include directions for performing certain acts, including drawing cards. The cards usually contain yet additional instructions to control the movement of the player's piece. The players sequentially advance their pieces about the board and, generally speaking, the first player to advance his piece to a particular position, or the first player to eliminate other pieces from the board, will be the winner.

Although certain prior games have achieved great popularity, people often easily master a particular game and become bored with it. There is a continuing market for games which challenge individuals in new and different ways. A particular challenge which retains universal appeal is that of gambling on the outcome of a particular event or sequence of events. Although games employing chance-taking apparatus by their very nature involve an element of chance, such games generally do not permit the participants to take yet additional chances on the outcome of a particular event. That is, the direction and/or extent of player movements about the board may be determined at random, but players cannot speculate in a meaningful or ordered manner regarding the outcome of a given player's actions.

SUMMARY OF THE INVENTION

In response to the foregoing considerations, the present invention provides a new and improved game apparatus employing a board and chance-taking means. The invention not only causes players to move in an ordered manner about the game board, but also permits inactive players to speculate regarding the outcome of actions about to be undertaken by an active player.

In a preferred embodiment, the invention includes a game board having direction-indicating indicia on its surface, the direction-indicating indicia showing possible movements which can be made away from the corners of the board. The invention includes direction-ordering apparatus in the form of so-called directional cards for directing movement away from the corners of the board. Each corner of the board is identified with respect to categories such as color, number, letter, or shape. A chance-taking means is located adjacent each identified corner of the board, a given chance-taking means being capable of selecting one of a number of different shapes, colors, letters, or numbers. The game apparatus further includes a number of so-called play cards, each card displaying a particular number, color, letter, or shape. In response to directions provided by the directional cards, players advance to different chance-taking means where they attempt to match particular colors, numbers, letters, or shapes with play cards in their possession. Inactive players may gamble on whether an active player will succeed in discarding a card in play. If the gamble is successful, the gambling players are permitted to discard gambled cards.

For a more complete understanding of the invention, including a description of the manner of play, reference is made to the specification as well as to the accompanying drawing which forms a part of the disclosure of the invention.

DESCRIPTION OF THE PREFERRED EMBODIMENT

Figure 1:
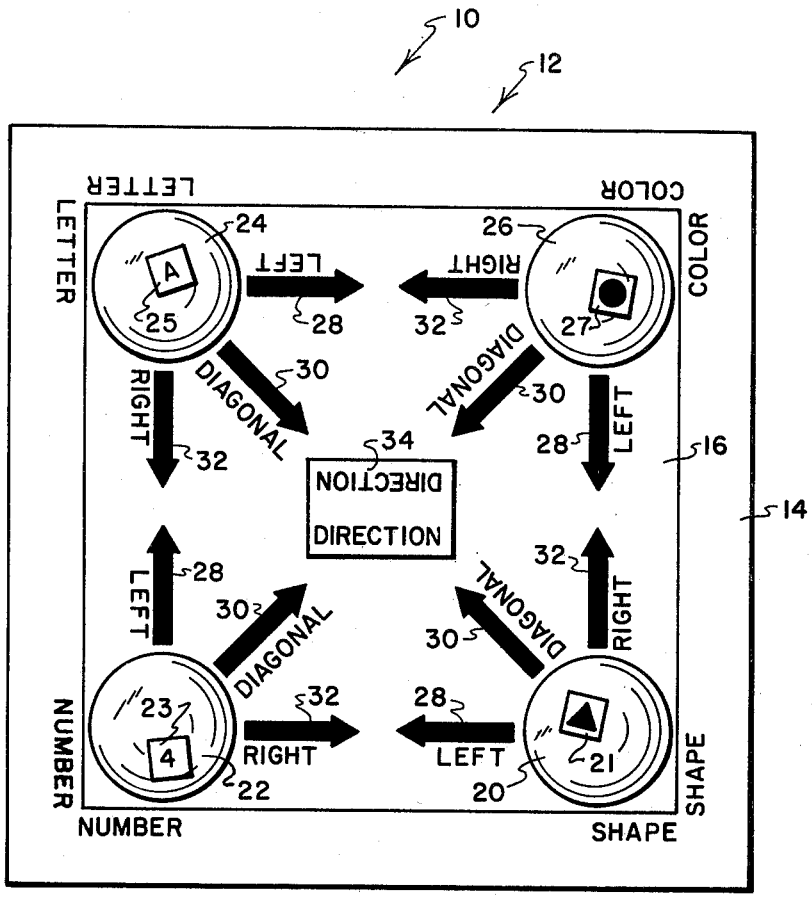
FIG. 1 is a plan view of a planar game board according to the invention, showing representative indicia and chance-taking means included as part of the invention.
Figure 2:
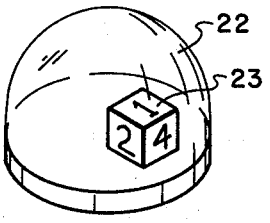
FIG. 2 is a perspective view of one type of chance-taking means which can be employed as part of the invention; and, FIG. 3 is a view of exemplary cards employed with the invention.

Referring to FIG. 1, game apparatus according to the present invention is shown and is generally designated by the numeral 10. The apparatus 10 includes a planar, rectangular game board 12. The board 12 includes a border 14 within which an area of play 16 is delineated. The border 14 is wide enough for cards to be placed there by players. A chance-taking means 20, 22, 24, and 26 is positioned at the corners of the playing area 16. Each chance-taking means 20, 22, 24, 26 includes a six-sided die 21, 23, 25, 27, respectively. The chance-taking means 20, 22, 24, 26 may be in the form of a die-agitating device, spinner, or any other suitable indicating apparatus. For example, U.S. Pat. No. 3,356,369, issued Dec. 5, 1967, to A. Stubbmann, discloses a suitable die-agitating chance device.

Direction-indicating indicia 28, 30, 32 emanate outwardly from each chance-taking means 20, 22, 24, 26. The direction-indicating indicia 28, 30, 32 essentially consist of differently configured arrows which also indicate desired directions of player movement. The arrow 28 includes the word "left" along its length and points to the left of each chance-taking means. The arrow 32 includes the word "right" along its length and points to the right of each chance-taking means. The arrow 30 includes the word "diagonal" along its length and points toward the diagonally opposite chance-taking means.

The chance-taking means 20 is identified by the term "shape". The die 21 associated with the chance-taking means 20 includes on its six sides six different shapes, such as a circle, triangle, rectangle, and so forth. The chance-taking means 22 is identified by the term "number". The die 23 associated with the chance-taking means 22 includes on its six surfaces six different numbers such as 1, 2, 3, etc. The chance-taking means 24 is identified by the term "letter". The die 25 associated with the chance-taking means 24 includes on its six surfaces six different letters such as A, B, C, etc. The chance-taking means 26 is identified by the term "color". The die associated with the chance-taking means 26 includes on its six surfaces six different colors such as red, blue, green, etc. It will be understood that different categories could be chosen, if desired. For example, depending upon the age level and interests of the players, categories of animals, cars, famous personalities and so forth could be used instead of shapes, colors, numbers, or letters.

Figure 3:
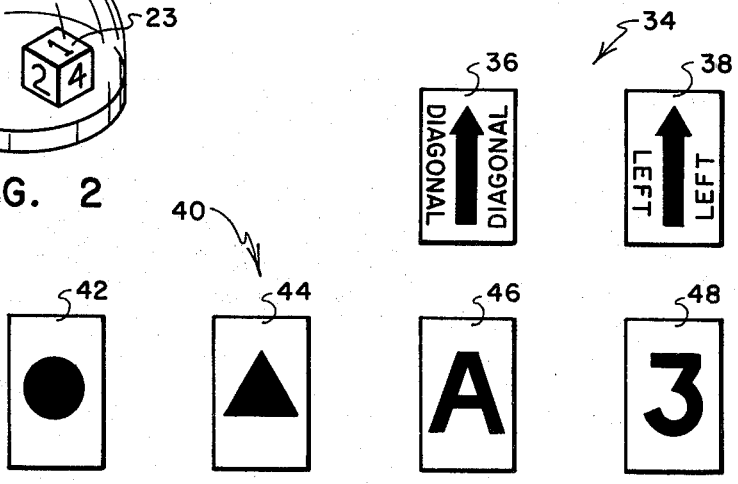

Direction-ordering apparatus 34 in the form of a plurality of so-called directional cards is located at the center of the board 12. There are 36 such directional cards, 12 for each direction indicated by the direction-indicating indicia 28, 30, 32. Sample directional cards 36, 38 are illustrated in FIG. 3, where directional card 36 corresponds with direction-indicating indicia 30 and directional card 38 corresponds with direction-indicating indicia 28.

The game apparatus 10 also includes a number of so-called play cards 40. Representative play cards 40 are illustrated in FIG. 3 by the numerals 42, 44, 46 and 48. The card 42 identifies a color corresponding with one of the colors included as part of the chance-taking means 26. The card 44 includes a shape included as part of the chance-taking means 20. The card 46 displays a letter included as part of the chance-taking means 24. The card 48 displays a number included as part of the chance-taking means 22. A total of 48 play cards are provided, two cards being provided for each die surface. Accordingly, 12 play cards 40 are provided for each category of shape, number, letter and color.

OPERATION

In order to play the game, a minimum of four play cards 40 are dealt to each player. Up to 12 players can play the game at any one time, in which event four cards 40 would be dealt to each player. If a few as two players are playing the game, up to 20 cards 40 can be dealt to each player. Generally speaking, the more play cards dealt to each player, the more difficult it will be to conclude the game. Accordingly, the number of cards to be dealt to each player for any given round of play can be selected by the players within the limits noted above.

The basic object of the game is to be the first player to discard all the play cards 40. Essentially, the discarding of play cards 40 is accomplished through the skillful use of directional cards, through luck in the operation of the chance-taking means 20, 22, 24, 26 and through the skillful and fortuitous placement of "gambles" (as will be described). Each player keeps the play cards 40 dealt to himself so that other players cannot see the play cards. If desired, the play cards 40 could be shown to the other players, but strategic decisions are enhanced if the play cards 40 are not so demonstrated. After the predetermined number of play cards 40 have been dealt, and after the directional cards 34 have been shuffled and placed face down at the center of the board 12, play is ready to begin.

A player arbitrarily is chosen to commence play. This player may be designated as the "first player". The first player chooses a category of letter, number, color, or shape which he desires to play. After the category has been chosen, the first player draws a single directional card 34. If it is desired to make the game somewhat easier to play, the first player could be permitted to draw a single directional card 34 prior to choosing a category of letter, number, color, or shape. Normally, however, a category of letter, number, color, or shape is selected prior to drawing a directional card.

Using the cards of FIG. 3 as an example, it will be assumed that the first player has been dealt play cards 42, 44, 46, and 48, has chosen "shape" as a category, and has drawn a left directional card (directional card 38). The player activates the chance-taking means 20, the first player hoping for a shape to appear on the die 21 corresponding to that of play card 44. It will be assumed that the chance-taking means 20 illustrated in FIG. 1 has just been played by the first player and that a triangle has been exposed on the upper surface of the die 21. This means that the first player has been successful and the play card 44 can be discarded. Because the first player holds a left directional card 38, a comparison then is made with the "number" chance-taking means 22. The die 23 associated with the chance-taking means 22 shows a "4" on its upper surface. Because the first player has a play card 48 showing a "3", a match is not made and the first player's turn is over. The directional card 38 is kept by the first player.

Because the first player could not continue play, the player to the left of the first player (the second player) is given a chance to play. Like the first player, the second player chooses a category of letter, number, color, or shape which he desires to play. After the category has been chosen, the second player draws a single directional card 34. Alternatively, like the manner of play described with respect to the first player, the directional card 34 could have been chosen before the category of letter, number, color, or shape had been selected. Play is carried out in a manner like that described with respect to the first player. It will be assumed that play cards 40 identical to the play cards 40 dealt to the first player also have been dealt to the second player (a distinct possibility) and the second player has selected "letter" as a category. It also will be assumed that the second player has chosen a diagonal directional card. Because he has been dealt a play card 46 having an "A", the second player is given the opportunity to actuate the chance-taking means 24 in an attempt to match the letter presented on the play card 46. It will be assumed that the chance-taking means 24 illustrated in FIG. 1 has just been played by the second player and that a letter A has been exposed on the upper surface of the die 25. This means that the second player has been successful and the play card 46 can be discarded. Because the second player holds a diagonal directional card, a comparison then is made with the "shape" chance-taking means 20. The die 21 associated with the chance-taking means 20 shows a triangle on its upper surface. Because the second player has a play card 44 showing a triangle, a match is made and the second player's turn continues. However, because the second player at this point has no other directional cards other than a diagonal card, and because the second player has discarded the only "letter" play card in his hand, the second player cannot continue to play and the player to the left of the second player commences to play. If the second player had been unsuccessful in initially matching the letter presented on the play card 46, he would have become an inactive player at that point and the player sitting immediately clockwise would have become the active player.

With respect to the placement of gambles, gambles are bets placed on an active player by other players waiting their turn (inactive players). By the skillful and fortuitous use of gambles, a player may rid himself of gambled cards. A gambling player must gamble at least the combination of one directional card 34 and one play card 40. He cannot gamble a directional card 34 by itself, nor can he gamble a play card 40 by itself. A directional card 34 and a play card 40 always must be gambled together. If a given player has two directional cards 34, then he can gamble both (along with accompanying play cards 40), or he can gamble only of the directional cards 34 (along with a single play card 40).

In placing a gamble, players are limited to a preexisting match between play cards 40 in their hand and matches with letters, numbers, colors or shapes on the dies 21, 23, 25, 27 already showing and differing from the category selected by the active player. That is, if the active player has selected "number" as a category, then the only play cards 40 that can be gambled by the inactive players would be those relating to letter, shape or color and those particular play cards 40 matching the upper surfaces of the dies 21, 25 and 27.

In order to gamble, the betting player places gambled cards face down in front of him in the border 14. If the active player is successful, the gamble also is successful and the gambling player may rid himself of all gambled cards. The gambling players must be prepared to display gambled cards to the other players prior to discarding successfully gambled cards. If the gamble is unsuccessful, the gambling player must discard the gambled directional cards 34, but retain the gambled play cards 40.

Directional cards 34 can be accumulated by each player, but no more than two can be held by any one player at the end of a turn. One directional card 34 must be drawn at the beginning of a player's turn. Play continues clockwise around the board 12, each player drawing a directional card 34 either at the beginning of his play or after having selected a desired category of number, shape, letter or color (as agreed upon previously by the players). Thereafter, the active player attempts to match numbers, shapes, letters or colors presented on the upper surfaces of the dies 21, 23, 25, 27 with play cards 40 held in his hand after having selected a desired category. As mentioned previously, the first player to rid himself of all the play cards 40 is the winner.

As an additional example of how the game is played, it will be assumed that a player has chosen "shape" as a category and has just activated the chance-taking means 20. It also will be assumed that the player has drawn a diagonal directional card 34. Accordingly, upon matching the play card 44 (triangle) with the upper surface of the die 21 which also shows a triangle, the player will be permitted to discard not only the play card 44, but also the play card 46 (showing the letter "A") and the diagonal directional card 34. If desired, a player need not discard a directional card 34 upon successfully matching a succeeding category, but it almost invariably will be in the player's best interests to discard the directional card 34. As mentioned previously, no more than two directional cards 34 can be retained by a player after any one turn has been completed.

Thus far, it has been assumed that the play cards dealt to the players have included no two play cards 40 alike. In the event a player receives two identical play cards and matches the play cards with a selected chance-taking means, the players by prearrangement can determine whether the player should be permitted to discard both cards, or should be permitted to discard only one of the two matched cards. Generally speaking, if there less than about four players, it will be more interesting to permit a player to discard both of the matched cards. On the other hand, if there are more than about four players, it will be more interesting for a player to be permitted to discard only one of the two matched cards.

It will be appreciated that the game apparatus according to the invention provides a challenge to the participants and, because inactive players can speculate on the outcome of an active player's actions, the invention appeals to the interest people have in the outcome of fortuitous events. Although the invention has been described with a certain degree of particularity, it will be understood that the present disclosure of the invention has been made only by way of example, and that various changes and modifications can be made without departing from the true spirit and scope of the invention as hereinafter claimed. It is intended that the patent shall cover, by suitable expression in the appended claims, whatever features of patentable novelty exist in the invention disclosed.

What is claimed is:

1. Game apparatus comprising, in combination:

(a) a planar game board having four corners, the board having direction-indicating indicia for indicating possible player movements to be made away from the corners of the board, the direction-indicating indicia including, at each corner of the board, first and second arrows pointing to each adjacent corner of the board, and a third arrow pointing to the diagonally opposite corner of the board, the first, second, and third arrows being separately identified;

(b) direction-ordering apparatus for directing player movements away from the corners of the board in a given direction, the direction-ordering apparatus including a plurality of so-called directional cards placed at or near the center of the board, each directional card having indicia corresponding to one of the direction-indicating indicia, a total of 36 directional cards being provided;

(c) chance-taking means included as part of the board, a separate chance-taking means being positioned at or near each corner of the board and adjacent the direction-indicating indicia, each chance-taking means permitting items within a different category of shape, number, letter, or color to be displayed at random, a given chance-taking means displaying different items within the same category, each chance-taking means including a die having six surfaces, each surface having a different indication of a common category of shape, number, letter, or color; and, (d) a plurality of play cards having indicia on one surface, the indicia corresponding to the indications of shape, number, letter, and color included as part of the chance-taking means, a total of 48 play cards being provided for possible indicated items determined by the chance-taking means, two play cards corresponding to the items displayed on each die surface.

2. Game apparatus comprising, in combination:

(a) a game board, the board having direction-indicating indicia for indicating possible player movements to be made away from the corners of the board, the direction-indicating indicia including, at each corner of the board, an arrow pointing to each adjacent corner of the board, and an arrow pointing to the center of the board;

(b) direction-ordering apparatus for directing player movements away from the corners of the board in a given direction, the direction-ordering apparatus corresponding to the arrows included as part of the direction-ordering indicia;

(c) a plurality of chance-taking means included as part of the board, the chance-taking means being positioned at or near the corners of the board and adjacent the direction-indicating indicia, each chance-taking means involving a selected category of items and permitting a different item within the selected category to be displayed at random, each chance-taking means including a die having six surfaces, with each surface having a different indication of items within the category dealt with by the chance-taking means; and (d) 48 play cards, each having indicia on one surface, the indicia corresponding to the indications of items within the categories dealt with by the chance-taking means, two play cards being provided for each corresponding die surface of each chance-taking means.

3. The game apparatus of claim 2, wherein each chance-taking means includes a die having a plurality of surfaces, each surface having a different indication of items within the category dealt with by the chance-taking means, and at least two play cards having indicia corresponding to each surface of each die.

4. The game apparatus of claim 3, wherein the categories of the chance-taking means include letters, numbers, shapes, and colors.

5. Game apparatus comprising, in combination:

(a) a game board having four corners, the board having direction-indicating indicia for indicating possible player movements to be made away from the corners of the board, the direction-indicating indicia including arrows pointing to adjacent corners of the board as well as to the center of the board;

(b) direction-ordering apparatus for directing player movements away from the corners of the board in a given direction, the direction-ordering apparatus corresponding to the direction-indicating indicia, the direction-ordering apparatus including a plurality of so-called directional cards, each directional card having indicia corresponding to one of the direction-indicating indicia, a total of 36 directional cards being provided, with 12 cards indicating leftward movement to an adjacent corner, 12 cards indicating rightward movement toward an adjacent corner, and 12 cards indicating movement toward a diagonally opposite corner;

(c) a plurality of chance-taking means included as part of the board, the chance-taking means being positioned at or near the corners of the board and adjacent the direction-indicating indicia, each chance-taking means involving a selected category of items and permitting a different item within the selected category to be displayed at random; and (d) a plurality of play cards each having indicia on one surface, the indicia corresponding to the indications of items within the categories dealt with by the chance-taking means.

6. The game apparatus of claim 5, wherein the surfaces of a given die deal with a category of shape, number, letter or color common to the die, with a different indication of shape, number, letter or color being provided for each surface of the die.

* * * * *